US007438768B2

(12) United States Patent
Sakaki et al.

(10) Patent No.: US 7,438,768 B2
(45) Date of Patent: Oct. 21, 2008

(54) RARE EARTH ELEMENT SINTERED MAGNET AND METHOD FOR PRODUCING RARE EARTH ELEMENT SINTERED MAGNET

(75) Inventors: Kazuaki Sakaki, Takefu (JP); Masaki Kasashima, Takefu (JP); Ryuji Hamada, Takefu (JP); Takehisa Minowa, Takefu (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 607 days.

(21) Appl. No.: 10/500,074

(22) PCT Filed: Dec. 24, 2002

(86) PCT No.: PCT/JP02/13430

§ 371 (c)(1),
(2), (4) Date: Jun. 25, 2004

(87) PCT Pub. No.: WO03/058648

PCT Pub. Date: Jul. 17, 2003

(65) Prior Publication Data

US 2005/0028890 A1 Feb. 10, 2005

(30) Foreign Application Priority Data

Dec. 28, 2001 (JP) ..... 2001-399174
Dec. 28, 2001 (JP) ..... 2001-399175
Dec. 28, 2001 (JP) ..... 2001-399176
Dec. 28, 2001 (JP) ..... 2001-399177

(51) Int. Cl.
*H01F 1/053* (2006.01)

(52) U.S. Cl. ..... 148/101; 148/122; 148/212; 148/301; 148/302; 148/303

(58) Field of Classification Search ..... None
See application file for complete search history.

(56) References Cited

U.S. PATENT DOCUMENTS 4,770,723 A * 9/1988 Sagawa et al. ..... 148/302
4,837,114 A * 6/1989 Hamada et al. ..... 427/527
4,966,668 A * 10/1990 Veistinen ..... 427/528
5,013,411 A 5/1991 Minowa et al.
5,382,303 A 1/1995 Anderson et al.
5,876,518 A * 3/1999 Hasegawa et al. ..... 148/302
6,080,498 A 6/2000 Kikui et al.
6,251,196 B1 6/2001 Nishiuchi et al.

(Continued)

FOREIGN PATENT DOCUMENTS

EP 0 345 092 12/1989

(Continued)

*Primary Examiner*—John P. Sheehan
(74) *Attorney, Agent, or Firm*—Birch, Stewart, Kolasch & Birch, LLP

(57) ABSTRACT

Hydrogen embrittlement is prevented in $Sm_2Co_{17}$-based magnets and $R_2Fe_{14}B$-based magnets by metal plating the magnet, then carrying out heat treatment, or by forming a metal oxide or metal nitride layer on the metal plating layer or directly on the magnet itself.

16 Claims, 2 Drawing Sheets

10μm

U.S. PATENT DOCUMENTS

| | | | | |
|---|---|---|---|---|
| 6,326,087 | B1 * | 12/2001 | Nishiuchi et al. | 428/611 |
| 6,399,150 | B1 * | 6/2002 | Yoshimura et al. | 427/242 |
| 6,623,541 | B2 * | 9/2003 | Sakaki et al. | 75/232 |
| 2001/0030590 | A1 * | 10/2001 | Nishiuchi et al. | 335/302 |
| 2002/0036029 | A1 * | 3/2002 | Kikugawa et al. | 148/101 |
| 2003/0041920 | A1 * | 3/2003 | Hoshi et al. | 148/122 |

FOREIGN PATENT DOCUMENTS

| | | | |
|---|---|---|---|
| JP | 56-81908 | * | 7/1981 |
| JP | 57066604 | | 4/1982 |
| JP | 59161610 | | 10/1984 |
| JP | 1-304713 | | 12/1989 |
| JP | 1-304713 | A | 12/1989 |
| JP | 3-129702 | A | 6/1991 |
| JP | 4-288804 | | 10/1992 |
| JP | 4-288804 | A | 10/1992 |
| JP | 05-226125 | A | 9/1993 |
| JP | 06-108190 | A | 4/1994 |
| JP | 06120014 | | 4/1994 |
| JP | 06-140218 | A | 5/1994 |
| JP | 8-181016 | | 7/1996 |
| JP | 2000-40610 | * | 8/2000 |
| JP | 2000-232011 | | 8/2000 |
| JP | 2000-285415 | A | 10/2000 |
| JP | 2001-167917 | A | 6/2001 |
| JP | 2002-118009 | A | 4/2002 |
| JP | 2002184615 | A | 6/2002 |

* cited by examiner

10μm

10μm

RARE EARTH ELEMENT SINTERED MAGNET AND METHOD FOR PRODUCING RARE EARTH ELEMENT SINTERED MAGNET

TECHNICAL FIELD

The present invention relates to rare-earth sintered magnets which can be used in devices such as motors exposed for a long period of time to a hydrogen atmosphere. The invention also relates to a method of manufacturing such magnets.

BACKGROUND ART

Intermetallic compounds of rare-earth elements and transition metals have an ability to allow hydrogen to infiltrate into their crystal lattice, that is, the ability to store and release hydrogen in and out of the alloy. This property is employed in a variety of applications, such as hydrogen cells that make use of hydrogen storage alloys as typified by $LaNi_5$. In rare-earth sintered magnet-related applications, the same property is used as a size reduction method for $R_2Fe_{14}B$-based alloys, and in the hydrogenation disproportionation desorption recombination (HDDR) process for producing $R_2Fe_{14}B$-based bonded magnets (JP-A 3-129702).

However, hydrogen storage and release in an alloy or magnet causes hydrogen embrittlement. Thus, when a motor or other device that uses a rare-earth sintered magnet is employed in a hydrogen atmosphere, the rare-earth sintered magnet undergoes hydrogen embrittlement, resulting in breaking, cracking or powdering of the magnet material.

Currently available rare-earth sintered magnets include $R_2Fe_{14}B$-based, $SmCo_5$-based and $Sm_2Co_{17}$-based magnets. Generally, a 1:5 crystal structure has a lower plateau pressure for hydrogen than a 2:17 crystal structure, and a 2:7 crystal structure has a lower plateau pressure than a 1:5 crystal structure. Thus, a rare earth-rich (abbreviated below as "R-rich") alloy tends to retain hydrogen more easily and to be more readily subject to hydrogen embrittlement.

$R_2Fe_{14}B$-based magnets have a R-rich phase in the magnet, as a result of which they readily undergo hydrogen embrittlement in hydrogen atmospheres at pressures of 0.1 MPa or less, leading to breaking, cracking or degradation of the magnet material. $R_2Fe_{14}B$-based magnets are usually given a surface treatment, such as plating or resin coating, to improve corrosion resistance, although such treatment is not a means for preventing hydrogen embrittlement. A solution is proposed in JP-A 2000-285415, which describes a method for including a hydrogen storage alloy in the surface treatment film on $R_2Fe_{14}B$-based magnets. $R_2Fe_{14}B$-based magnets produced by this method do not undergo hydrogen embrittlement in hydrogen atmospheres at pressures of 0.1 MPa or less, but they apparently undergo hydrogen embrittlement in hydrogen atmospheres at higher pressures than this, leading to breaking, cracking or degradation of the magnet material.

$SmCo_5$-based magnets, like $R_2Fe_{14}B$-based magnets, have a R-rich phase. In addition, the $SmCo_5$ phase, which is the main phase, has a plateau pressure of about 0.3 MPa. Hence, in a hydrogen atmosphere at a pressure higher than 0.3 MPa, hydrogen embrittlement occurs, resulting in breaking, cracking or degradation of the magnet material.

In $Sm_2Co_{17}$-based magnets, the main phase is a 2:17 phase. Unlike $R_2Fe_{14}B$-based magnets and $SmCo_5$-based magnets, $Sm_2Co_{17}$-based magnets are not R-rich and do not contain an R-rich phase. Hence, they are not readily subject to hydrogen embrittlement. However, in hydrogen atmospheres at pressures higher than 1 MPa, $Sm_2Co_{17}$-based magnets too, like the other types of rare-earth sintered magnets mentioned above, undergo hydrogen embrittlement, resulting in breaking, cracking or degradation of the magnet material.

DISCLOSURE OF THE INVENTION

The object of the invention is to provide rare-earth sintered magnets and methods of manufacture thereof which resolve the problem of hydrogen embrittlement that occurs in prior-art rare-earth sintered magnets within a hydrogen atmosphere, and the resulting breaking, cracking or degradation of the magnet material.

To enhance the resistance to hydrogen embrittlement, we earlier proposed, in JP-A 2002-118009, a process wherein a $Sm_2Co_{17}$-based sintered magnet is surface-machined by cutting and/or grinding, then heat-treated in an atmosphere having an oxygen partial pressure of from $1\times10^{-6}$ to 152 torr, or wherein a microdispersed $Sm_2O_3$-containing layer of cobalt and/or cobalt and iron is provided on the surface of a $Sm_2Co_{17}$-based magnet. When a microdispersed $Sm_2O_3$-containing layer of cobalt and/or cobalt and iron is provided on the magnet surface, hydrogen embrittlement does not arise even in a high-pressure hydrogen atmosphere having a pressure higher than 3 MPa. However, because the $Sm_2Co_{17}$-based magnet and the microdispersed $Sm_2O_3$-containing layer of cobalt and/or cobalt and iron are hard and fragile, they tend to chip when handled, such as during product assembly. Although damage such as chipping has substantially no effect on the magnetic properties of rare-earth sintered magnets, it has a large effect on the resistance of the magnet to hydrogen embrittlement, reducing such resistance to the same level as that of a magnet having no surface layer.

Therefore, in hydrogen atmospheres at pressures higher than 1 MPa, hydrogen embrittlement occurs, leading to breaking, cracking or degradation of the magnet material. Use in such an atmosphere is thus impossible.

The cause of the above problem is the low mechanical strength of $Sm_2Co_{17}$-based magnets. The hydrogen resistance can be maintained if a mechanical strength of $Sm_2Co_{17}$-based magnet is improved or chipping is prevented. $R_2Fe_{14}B$-based magnets have a higher mechanical strength than $Sm_2Co_{17}$-based magnets, in addition to which they generally have a non-oxidizable surface film. As a result, they are less likely to incur damage such as chipping. Covering a $R_2Fe_{14}B$-based magnet with a hydrogen-resistant film would thus appear to be an effective solution.

Although $R_2Fe_{14}B$-based magnets have a number of drawbacks compared with $Sm_2Co_{17}$-based magnets, such as a lower corrosion resistance and inferior temperature properties, the principal elements are neodymium and iron, both of which are inexpensive, rather than the expensive elements samarium and cobalt. Hence, the starting material costs are low. Moreover, with regard to the highest magnetic properties of rare-earth sintered magnets currently in mass production, $R_2Fe_{14}B$-based magnets have a maximum energy product of 50 MGOe, which is larger than the maximum energy product of 32 MGOe for $Sm_2Co_{17}$-based magnets. Once they have been surface-treated to improve their corrosion resistance, $R_2Fe_{14}B$-based magnets are outstanding permanent magnet materials at ambient temperatures. In applications where excellent temperature properties are not required or where the magnet is not subjected to temperatures above 150° C., $R_2Fe_{14}B$-based magnets are commonly used in place of $Sm_2Co_{17}$-based magnets to provide magnetic circuits of smaller size and higher efficiency. It is thus evident that, were $R_2Fe_{14}B$-based magnets to have hydrogen resistance, their magnetic properties would make them much more effective than $Sm_2Co_{17}$-based magnets.

In light of the above circumstances, we have conducted extensive investigations to achieve the foregoing aims. As a result, we have discovered a method of manufacturing rare-earth sintered magnets that do not undergo hydrogen embrittlement even in a high-pressure hydrogen atmosphere. The method involves surface machining a sintered and aged magnet, then metal-plating the surface-machined magnet and subjecting it to optimal heat treatment so as to form on the surface of the magnet a layer of excellent hydrogen resistance. We have found that $Sm_2Co_{17}$-based sintered magnets and $R_2Fe_{14}B$-based sintered magnets highly suitable for use in devices such as motors exposed for long periods of time to a hydrogen atmosphere can be obtained in this way.

Moreover, we have also discovered that forming a metal oxide layer and/or a metal nitride layer on the surface of a $Sm_2Co_{17}$-based or $R_2Fe_{14}B$-based sintered magnet, either directly or over an intervening metal-plating layer, keeps hydrogen embrittlement from arising even in a high-pressure hydrogen atmosphere. There can thus be obtained $Sm_2Co_{17}$-based or $R_2Fe_{14}B$-based sintered magnets highly suitable for use in devices such as motors exposed for long periods of time to a hydrogen atmosphere.

Accordingly, the invention provides the following rare-earth sintered magnets and methods of manufacture thereof.

(1) A method of manufacturing rare-earth sintered magnets, characterized by subjecting an alloy composed of 20 to 30 wt % of a constituent R (R being samarium alone or at least 50 wt % samarium in combination with one or more other rare-earth element), 10 to 45 wt % iron, 1 to 10 wt % copper and 0.5 to 5 wt % zirconium, with the balance being cobalt and inadvertent impurities, to the steps of, in order, melting, casting, coarse size reduction, milling, molding in a magnetic field, sintering and aging so as to form a sintered magnet, surface machining the sintered magnet by cutting and/or grinding, metal plating the surface-machined magnet, then heat treating the metal-plated magnet at 80 to 850° C. for a period of from 10 minutes to 50 hours.

(2) A rare-earth sintered magnet composed of 20 to 30 wt % of a constituent R (R being samarium alone or at least 50 wt % samarium in combination with one or more other rare-earth element), 10 to 45 wt % iron, 1 to 10 wt % copper and 0.5 to 5 wt % zirconium, with the balance being cobalt and inadvertent impurities, which rare-earth sintered magnet is characterized by having on a surface thereof, either directly or over an intervening metal-plating layer, a metal oxide layer and/or a metal nitride layer.

(3) A method of manufacturing rare-earth sintered magnets, characterized by subjecting an alloy composed of 20 to 35 wt % of a constituent R (R being one or more rare-earth element selected from among neodymium, praseodymium, dysprosium, terbium and holmium), up to 15 wt % cobalt, 0.2 to 8 wt % boron, and up to 8 wt % of one or more element selected from among nickel, niobium, aluminum, titanium, zirconium, chromium, vanadium, manganese, molybdenum, silicon, tin, gallium, copper and zinc as an additive, with the balance being iron and inadvertent impurities, to the steps of, in order, melting, casting, coarse size reduction, milling, molding in a magnetic field, sintering and heat treatment to form a sintered magnet, surface machining the sintered magnet by cutting and/or grinding, metal plating the surface-machined magnet, then heat treating the metal-plated magnet at 80 to 700° C. for a period of from 10 minutes to 50 hours.

(4) A rare-earth sintered magnet composed of 20 to 35 wt % of a constituent R (R being one or more rare-earth element selected from among neodymium, praseodymium, dysprosium, terbium and holmium), up to 15 wt % cobalt, 0.2 to 8 wt % boron, and up to 8 wt % of one or more element selected from among nickel, niobium, aluminum, titanium, zirconium, chromium, vanadium, manganese, molybdenum, silicon, tin, gallium, copper and zinc as an additive, with the balance being iron and inadvertent impurities, which rare-earth sintered magnet is characterized by having on a surface thereof, either directly or over n metal-plating layers (n being an integer such that $n \geqq 1$), a metal oxide layer and/or a metal nitride layer.

BEST MODE FOR CARRYING OUT THE INVENTION

$Sm_2Co_{17}$-Based Sintered Magnet Alloy

Figure 1:
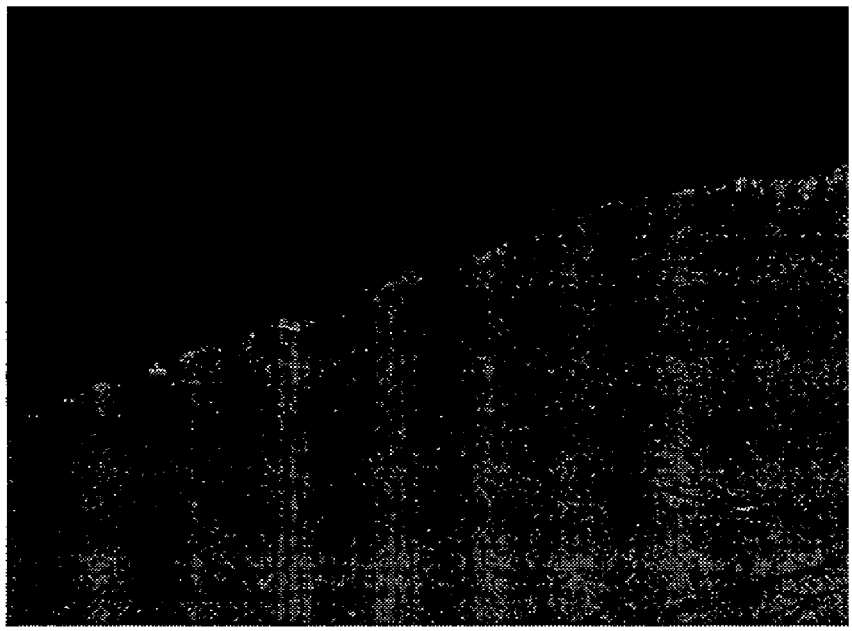
FIG. 1 is a reflection electron microscopy image obtained with a scanning electron microscope of the area near the surface of the magnet produced in Example 3 by covering a rare-earth sintered magnet with a 15 μm layer of plated nickel, then heat-treating at 600° C. for 24 hours in air.

The $Sm_2Co_{17}$-based sintered magnet alloy used in the invention is composed primarily of 20 to 30 wt % of a rare-earth constituent which is samarium alone or at least 50 wt % samarium in combination with at least one other rare-earth element, 10 to 45 wt % of iron, 1 to 10 wt % of copper and 0.5 to 5 wt % of zirconium, with the balance being cobalt and inadvertent impurities. Illustrative, non-limiting examples of the above rare-earth elements other than samarium include neodymium, cesium, praseodymium and gadolinium. Magnets having effective magnetic properties are not obtained when the samarium content of the rare-earth constituent in the alloy is less than 50 wt %, or when the alloy has a rare-earth element content of less than 20 wt % or more than 30 wt %.

$R_2Fe_{14}B$-Based Sintered Magnet Alloy

The $R_2Fe_{14}B$-based sintered magnet alloy used in the invention is composed primarily of 20 to 35 wt % of a constituent R (R being one or more rare-earth element selected from among neodymium, praseodymium, dysprosium, terbium and holmium), more than 0 wt % and up to 15 wt % of cobalt, 0.2 to 8 wt % of boron, and more than 0 wt % and up to 8 wt % of at least one element selected from among nickel, niobium, aluminum, titanium, zirconium, chromium, vanadium, manganese, molybdenum, silicon, tin, gallium, copper and zinc as an additive, with the balance being iron and inadvertent impurities. At a constituent R content lower than 20 wt %, magnets obtained from the alloy have a markedly diminished coercivity. At a constituent R content higher than 35 wt %, magnets obtained from the alloy have a markedly diminished residual flux density.

First Method of the Invention

The first method of the invention is characterized by subjecting a magnet alloy of the above-indicated composition to the steps of, in order, melting, casting, coarse size reduction, milling, molding in a magnetic field, sintering and heat treatment so as to form a sintered magnet. Next, the sintered magnet is surface-machined by cutting and/or grinding, then metal plated, after which the metal-plated magnet is heat treated at 80 to 850° C. for a period of from 10 minutes to 50 hours.

Describing the process more specifically, a $Sm_2Co_{17}$- or $R_2Fe_{14}B$-based sintered magnet alloy according to the invention is prepared by induction melting a starting material having a composition within the above-indicated ranges in a non-oxidizing atmosphere such as argon, then casting the molten material.

Next, the $Sm_2Co_{17}$-based or $R_2Fe_{14}B$-based magnet alloy is subjected to coarse size reduction, then milled to an average particle size of preferably 1 to 10 μm, and most preferably about 5 μm. Coarse size reduction can be carried out in an inert gas atmosphere by means of, for example, a jaw crusher, a Braun mill, a pin mill or hydrogen occlusion. Milling can be carried out, for example, in a wet ball mill using a solvent such as alcohol or hexane, in a dry ball mill under an inert gas atmosphere, or in a jet mill using a stream of inert gas.

Next, in the production of $Sm_2Co_{17}$-based magnets, the milled powder is compression molded such as with a magnetic field-generating press capable of applying a magnetic field of preferably at least 10 kOe, and most preferably at least 15 kOe, and under an applied pressure of preferably at least 500 kg/cm$^2$ but less than 2,000 kg/cm$^2$. The resulting powder compact is sintered and solution treated with a heat treatment furnace in a non-oxidizing gas atmosphere such as argon at a temperature 1100 to 1300° C., and preferably 1150 to 1250° C., for a period of 0.5 to 5 hours. Following completion of these steps, the sintered and solution-treated compact is quenched. Next, the compact is subjected to aging treatment in which it is held in an argon atmosphere at a temperature of 700 to 900° C., and preferably 750 to 850° C., for a period of 5 to 40 hours, then gradually cooled to 400° C. at a rate of −1.0° C./min. The compact is then surface-machined and finished by cutting and/or grinding. It is desirable, though not essential, to chamfer the edges of the rare-earth sintered magnet at this time.

In the production of $R_2Fe_{14}B$-based magnets, the milled powder is compression molded such as with a magnetic field-generating press capable of applying a magnetic field of preferably at least 10 kOe, and most preferably at least 15 kOe, under an applied pressure of preferably at least 200 kg/cm$^2$ but less than 2,000 kg/cm$^2$. The resulting powder compact is sintered with a heat treatment furnace in a high vacuum or a non-oxidizing gas atmosphere such as argon at a temperature of 1000 to 1200° C. for a period of 1 to 2 hours. Next, the compact is heat-treated in a vacuum or a non-oxidizing gas atmosphere such as argon, at a temperature lower than the sintering temperature, and preferably 400 to 700° C., then surface-machined and finished by cutting and/or grinding. It is desirable time to chamfer the edges of the rare-earth sintered magnet at this time.

After the rare-earth sintered magnet has been surface-machined, a metal plating layer is formed thereon. The higher the number of metal plating layers, the better the resulting corrosion resistance. However, given that more layers results in higher production costs, lower production efficiency and diminished magnetic properties, the number of such layers may be set at 1 to 5 layers and, in the case of $R_2Fe_{14}B$-based magnets in particular, 2 to 5 layers. The number of layers is preferably selected on the basis of such considerations as the corrosion resistance required of the intended application. The metal-plating metal is preferably one or more selected from among copper, nickel, cobalt, tin, and alloys thereof. The plating thickness is preferably 1 to 100 μm, and most preferably 1 to 50 μm. Preferred multilayer platings include those composed of a copper bottom layer followed by one or more nickel layer, such as Cu—Ni, Cu—Ni—Ni, and Ni—Cu—Ni.

No particular limitation is imposed on pretreatment for such metal plating, although it is preferable for the rare-earth sintered magnet prior to plating to be alkali cleaned, acid cleaned, and rinsed with water. The plating coat-forming method is not subject to any particular limitation, although electroplating is preferred. Immersion of the rare-earth sintered magnet in the plating solution may be carried out by a barrel process or a rack process, suitable selection of the process used being made in accordance with the dimensions and shape of the rare-earth sintered magnet.

The electroplating solution used may be a plating solution of a known composition. Plating can be carried out under known conditions for the plating solution, although a plating solution having a pH of 2 to 12 is especially preferred. In cases where metals of differing compositions are deposited as two or more layers, it is desirable for the layer directly beneath the topmost layer to have a corrosion potential which is noble to the topmost layer. In methods where the potential is controlled by varying the sulfur content of the coat, as is done when plating two layers of nickel, it is desirable for the top layer to have a sulfur content of about 0.03% or less and the bottom layer to be sulfur-free. Illustrative, non-limiting examples of other combinations include nickel as the topmost layer in combination with copper as the bottommost layer.

After metal plating has been carried out by the above method, the magnet is heat-treated in an argon, nitrogen, air or vacuum atmosphere having an oxygen partial pressure of from $1\times10^{-4}$ Pa to 50 kPa, and preferably $1\times10^{-4}$ Pa to 30 kPa, for a period of from 10 minutes to 50 hours, and at a temperature of 80 to 850° C., preferably 80 to 700° C., and most preferably 200 to 600° C. In the case of $R_2Fe_{14}B$-based magnets, the upper limit in the temperature is preferably 700° C. A heat treatment time of less than 10 minutes is inappropriate because a layer of excellent hydrogen resistance either does not sufficiently form or formation is highly variable. On the other hand, heat treatment for more than 50 hours is inappropriate because it is inefficient and the resulting layer, though having an excellent hydrogen resistance, is so thick as to diminish the magnetic properties of the magnet. At a heat treatment temperature of less than 80° C., a long period of heat treatment is necessary to obtain rare-earth sintered magnets of excellent hydrogen resistance, which is inefficient. On the other hand, at too high a temperature, a layer of excellent hydrogen resistance does form, but the rare-earth sintered magnet and the metal plating react, diminishing the magnetic properties of the magnet. The above-mentioned layer of excellent hydrogen resistance is an oxide layer of the plating metal which has a thickness of preferably 0.1 to 100 μm, and most preferably 0.1 to 20 μm.

Next, the surface of the rare-earth sintered magnet may be resin coated by a technique such as spray coating, electrodeposition coating, powder coating or dip coating. The resin coat thus obtained does not have hydrogen resistance. Rather, it is formed in cases where, depending on the working atmosphere of the motor or other device in which the rare-earth sintered magnet is used, the magnet may need to be acid-resistant, and to prevent scratching of the surface layer on the magnet when it is installed in a motor or other device.

The resin used in resin coating is not subject to any particular limitation. Desirable examples include acrylic, epoxy, phenolic, silicone, polyester and polyurethane-based resins.

Second Method of the Invention

In the second method of the invention, a metal oxide layer and/or metal nitride layer is formed on the surface of a $Sm_2Co_{17}$-based or $R_2Fe_{14}B$-based sintered magnet, either directly or over an intervening metal plating layer.

More specifically, the $Sm_2Co_{17}$-based or $R_2Fe_{14}B$-based sintered magnet of the invention is a rare-earth sintered magnet of the above-described composition having on the surface thereof a metal oxide layer and/or metal nitride layer, either directly on the magnet surface or over n intervening metal-plating layers (n being an integer such that $n \geqq 1$, preferably $5 \geqq n \geqq 1$ and, particularly in the case of $R_2Fe_{14}B$-based sintered magnets, most preferably $5 \geqq n \geqq 2$), which effectively prevents hydrogen embrittlement from arising.

The metal oxide layer and metal nitride layer may be formed directly on the magnet surface by any of various vapor phase plating techniques, or may be formed by any of various vapor phase plating techniques after first forming a metal plating layer on the magnet surface. Alternatively, a metal plating layer may be formed, following which at least the surface of the metal plating layer may be oxidized and/or nitrided such as by heating in an air or other oxidizing atmosphere or in a nitrogen atmosphere. In the latter case, the entire metal plating layer that has formed may be oxidized and/or nitrided.

In this case, the metal plating layer does not have hydrogen resistance. Rather, it is applied to enhance the impact resistance of $Sm_2Co_{17}$ sintered magnets, which have a low mechanical strength and are prone to chipping and other damage, or to enhance the corrosion resistance of $R_2Fe_{14}B$-based magnets, which have a low corrosion resistance.

The metal plating layer and the metal oxide layer and/or metal nitride layer have a combined thickness of preferably at least 1 μm but not more than 100 μm. The thickness of the topmost metal oxide layer and/or metal nitride layer is preferably at least 0.1 μm but not more than 100 μm. The combined thickness of the metal plating layer and the metal oxide layer and/or metal nitride layer is most preferably at least 1 μm but not more than 50 μm, and the thickness of the metal oxide layer and/or metal nitride layer is most preferably at least 0.1 μm but not more than 20 μm. At a combined thickness for the metal plating layer and the metal oxide layer and/or metal nitride layer of more than 100 μm, production tends to be time-consuming, costly, and inefficient. Moreover, such a thickness may adversely impact the magnetic properties of the magnet. On the other hand, a combined thickness of less than 1 μm may be inadequate to improve the impact resistance of the sintered magnet, making it difficult to prevent chipping and other damage. In addition, the metal plating tends to be uneven and have a larger number of pinholes, as a result of which formation of an adequate metal oxide layer and/or a metal nitride layer of excellent hydrogen resistance may not occur. At a thickness of more than 100 μm, the metal oxide layer and/or metal nitride layer does prevent hydrogen embrittlement of the magnet itself, but production tends to be time-consuming, costly, and inefficient. In addition, the very thickness of the layer itself may diminish the magnetic properties of the magnet. At a thickness of less than 0.1 μm, the metal oxide layer and/or metal nitride layer may fail to provide effective resistance to hydrogen embrittlement.

No particular limitation is imposed on the method of manufacturing sintered magnets having such a metal oxide layer and/or metal nitride layer directly on the surface thereof or over an intervening metal plating layer. However, as in the case described above in connection with the first method of the invention, use is preferably made of a method in which an alloy of the above-described composition is successively cast, subjected to coarse size reduction and also preferably milled, then molded in a magnetic field, sintered and heat-treated to form a sintered magnet. Next, the magnet is typically surface-machined and finished, then metal plated, after which oxidation and/or nitriding treatment is carried out, followed by resin coating.

After metal plating has been formed in the same way as described above for the first method of the invention, a metal oxide layer and/or metal nitride layer, preferably of the metal in the top metal plating layer, is formed on the resulting metal plating surface. Accordingly, the metal oxide and/or metal nitride is preferably an oxide and/or nitride of copper, nickel, cobalt, tin, or an alloy thereof. Illustrative, non-limiting methods for forming such layers include vapor-phase plating processes such as vacuum deposition, ion sputtering and ion plating, chemical processes, heat treatment in various atmospheres such as an air atmosphere, under oxygen partial pressure regulation, in nitrogen or in pressurized nitrogen, and electrolytic treatment. The metal oxide layer and/or metal nitride layer has a thickness of preferably 0.1 to 100 μm, and most preferably 0.1 to 20 μm.

As described above for the first method of the invention, the surface of the rare-earth sintered magnet which has been treated in this way can then be resin-coated (e.g., spray-coated, electrodeposition-coated, powder-coated or dip-coated). The resin coat thus obtained does not have hydrogen resistance. Rather, it is formed in cases where, depending on the working atmosphere of the motor or other device in which the rare-earth magnet is used, the magnet may need to be acid-resistant, and to prevent scratching of the surface layer on the magnet during transportation or when it is installed in a motor or other device. The resin used in resin coating is not subject to any particular limitation. Desirable examples include acrylic, epoxy, phenolic, silicone, polyester and polyurethane-based resins. Resin coating is carried out by resin coating techniques such as spray coating, electrodeposition coating, powder coating or dip coating to a resin coat thickness of preferably at least 1 μm but not more than 3 mm, and preferably at least 10 μm but not more than 1 mm. At a thickness of less than 1 μm, uniform coating is not easy. Moreover, a surface layer-protecting effect is difficult to achieve during transportation and when of the rare-earth sintered magnet is installed in a motor or other device. Resin coating to a thickness of more than 3 mm tends to make production time-consuming, costly and inefficient.

EXAMPLE

Examples are given below to illustrate the invention, and are not intended to limit the scope thereof.

Example 1

A $Sm_2Co_{17}$-based magnet alloy was produced by formulating a starting material containing 25.0 wt % of samarium, 17.0 wt % iron, 4.5 wt % of copper and 2.5 wt % of zirconium, with the balance being cobalt. The starting material was placed in an alumina crucible and melted in an induction melting furnace under an argon atmosphere, then cast in a mold.

The resulting $Sm_2Co_{17}$-based magnet alloy was reduced to a size of about 500 μm or less with a jaw crusher and a Braun mill, after which it was milled to an average particle size of about 5 μm with a jet mill using a stream of nitrogen. The milled powder was molded with a magnetic field-generating press under a pressure of 1.5 t/cm$^2$ within a magnetic field of 15 kOe. The resulting powder compacts were sintered in a heat treatment furnace under an argon atmosphere at 1190° C. for 2 hours, then solution-treated in argon at 1175° C. for 1 hour. Following the completion of solution treatment, the sintered compacts were quenched, then each was held in an argon atmosphere at 800° C. for 10 hours and gradually cooled to 400° C. at a rate of −1.0° C./min, thereby giving sintered magnets. Magnets measuring 5×5×5 mm were cut from the sintered magnets.

A 20 μm layer of copper was electroplated onto the resulting magnets using a plating bath adjusted to concentrations of 60 g/L copper pyrophosphate, 240 g/L potassium pyrophosphate and 30 g/L potassium oxalate, and at a bath temperature of 40° C. and a current density of 1.5 A/dm$^2$. The plated magnets were subsequently heat treated at 550° C. for 12 hours in air (oxygen partial pressure, 20 kPa), slowly cooled to room temperature, then coated by spraying on an epoxy resin, yielding hydrogen gas test specimens. Measurement of the magnetic properties was carried out using a vibrating sample magnetometer (VSM).

The hydrogen gas test specimens were subjected to a hydrogen gas test in which they were placed in a pressure vessel, sealed within hydrogen at 10 MPa and 25° C. and left under these conditions for one day, then removed. Following removal, the appearance of the magnets was visually checked and their magnetic properties were measured with a VSM.

Example 2

Sintered magnets were produced in the same composition and by the same method as in Example 1. As in Example 1, magnets measuring 5×5×5 mm were cut from the resulting sintered magnets. A 20 μm layer of copper was electroplated onto the resulting magnets under the same conditions as in Example 1. The plated magnets were heat treated at 550° C. for 12 hours in a vacuum (oxygen partial pressure, $1\times10^{-2}$ Pa), then slowly cooled to room temperature and subsequently coated by spraying on an epoxy resin, yielding hydrogen gas test specimens. The magnetic properties of the test specimens were measured with a VSM. The hydrogen gas test specimens were subjected to a hydrogen gas test under the same conditions as in Example 1, then removed from the pressure vessel. Following removal, the appearance of the magnets was visually checked and their magnetic properties were measured with a VSM.

Comparative Example 1

Sintered magnets were produced in the same composition and by the same method as in Example 1. As in Example 1, magnets measuring 5×5×5 mm were cut from the resulting sintered magnets and coated by spraying on an epoxy resin to give hydrogen gas test specimens. The magnetic properties of the test specimens were measured with a VSM. The hydrogen gas test specimens were subjected to a hydrogen gas test under the same conditions as in Example 1, then removed from the pressure vessel. Following removal, the appearance of the magnets was visually checked.

Comparative Example 2

Sintered magnets of the same composition as in Example 1 were produced in the same way as in that example. As in Example 1, magnets measuring 5×5×5 mm were cut from the resulting sintered magnets. A 20 μm layer of copper was electroplated onto the resulting magnets under the same conditions as in Example 1, in addition to which the magnets were coated by spraying on an epoxy resin to give hydrogen gas test specimens. The magnetic properties of the test specimens were measured with a VSM. The hydrogen gas test specimens were subjected to a hydrogen gas test under the same conditions as in Example 1, then removed from the pressure vessel. Following removal, the appearance of the magnets was visually checked.

Comparative Examples 3 and 4

Sintered magnets were produced in the same composition and by the same method as in Example 1. As in Example 1, magnets measuring 5×5×5 mm were cut from the resulting sintered magnets. A 20 μm layer of copper was electroplated onto the resulting magnets under the same conditions as in Example 1. In Comparative Example 3, heat treatment was subsequently carried out at 50° C. for 12 hours in air (oxygen partial pressure, 20 kPa). In Comparative Example 4, heat treatment was subsequently carried out at 900° C. for 12 hours in air (oxygen partial pressure, 20 kPa). In both examples, the heat-treated magnets were slowly cooled to room temperature, then coated by spraying on an epoxy resin to give hydrogen gas test specimens. The magnetic properties of the test specimens were measured with a VSM. The hydrogen gas test specimens were subjected to a hydrogen gas test under the same conditions as in Example 1, then removed from the pressure vessel. Following removal, the appearance of the magnets was visually checked and their magnetic properties were measured with a VSM.

TABLE 1

| | Surface treatment conditions | Hydrogen gas test conditions | Appearance after hydrogen gas test | Thickness of surface layer |
|---|---|---|---|---|
| Example 1 | Cu plating (20 μm) + 550° C., 12-hour heat treatment ($O_2$: 20 kPa) | 10 MPa 25° C. 1 day | no change | 5 μm |
| Example 2 | Cu plating (20 μm) + 550° C., 12-hour heat treatment ($O_2$: $1\times10^{-2}$ Pa) | | no change | 1 μm |
| Comparative Example 1 | not surface treated | | disintegrated | — |
| Comparative Example 2 | Cu plating (20 μm) | | disintegrated | — |

TABLE 1-continued

| | Surface treatment conditions | Hydrogen gas test conditions | Appearance after hydrogen gas test | Thickness of surface layer |
|---|---|---|---|---|
| Comparative Example 3 | Cu plating (20 μm) + 50° C., 12-hour heat treatment ($O_2$: 20 kPa) | | disintegrated | not measurable* |
| Comparative Example 4 | Cu plating (20 μm) + 900° C., 12-hour heat treatment ($O_2$: 20 kPa) | | no change | 20 μm |

*An oxide layer did form, but it was too thin to be measured.

Table 1 shows the heat treatment conditions, the hydrogen gas test conditions, and the appearance of the magnets following the hydrogen gas test. In Examples 1 and 2 and Comparative Example 4, no change occurred in the hydrogen gas test. However, in Comparative Examples 1, 2 and 3, the magnet disintegrated into small pieces. It is apparent from this that hydrogen embrittlement did not arise in Examples 1 and 2 and Comparative Example 4.

TABLE 2

| | Before surface treatment | | | Before hydrogen gas test | | | After hydrogen gas test | | |
|---|---|---|---|---|---|---|---|---|---|
| | Br (kG) | iHc (kOe) | $(BH)_{max}$ (MGOe) | Br (kG) | iHc (kOe) | $(BH)_{max}$ (MGOe) | Br (kG) | iHc (kOe) | $(BH)_{max}$ (MGOe) |
| Example 1 | 11.02 | 14.55 | 28.2 | 11.00 | 14.85 | 28.0 | 11.00 | 14.83 | 28.0 |
| Example 2 | 11.05 | 14.88 | 28.4 | 11.03 | 15.05 | 28.2 | 11.03 | 14.98 | 28.2 |
| Comparative Example 1 | 11.03 | 14.32 | 28.3 | 11.03 | 14.32 | 28.3 | | | |
| Comparative Example 2 | 11.02 | 14.45 | 28.1 | 11.00 | 14.40 | 28.0 | | | |
| Comparative Example 3 | 11.02 | 14.50 | 28.1 | 10.99 | 14.40 | 27.9 | | | |
| Comparative Example 4 | 11.03 | 14.66 | 28.2 | 11.00 | 3.51 | 11.5 | 11.00 | 3.45 | 11.5 |

Table 2 shows the magnetic properties of the magnets before surface treatment and before and after the hydrogen gas test. In Examples 1 and 2 according to the invention, the magnetic properties of the magnets remained substantially unchanged before surface treatment and before and after the hydrogen gas test. By contrast, in Comparative Example 4, the magnetic properties of the magnet before surface treatment were very different from those before the hydrogen gas test. These results indicate the absence in Examples 1 and 2 of deterioration in magnetic properties due to surface treatment and the absence of hydrogen embrittlement. The results also indicate that surface treatment in Comparative Example 4 led to a deterioration in the magnetic properties. In Comparative Examples 1, 2 and 3, the magnets disintegrated as a result of hydrogen treatment, making it impossible to measure the magnetic properties following hydrogen treatment.

Thus, Tables 1 and 2 show that, in Comparative Examples 1 to 4, surface treatment either led to a clear deterioration in the magnetic properties of the magnets or failed to improve their hydrogen resistance. By contrast, in Examples 1 and 2, surface treatment did not lead to a deterioration in magnetic properties and improved the hydrogen resistance.

Example 3

A $Sm_2Co_{17}$-based magnet alloy was produced by formulating a starting material containing 18.0 wt % of samarium, 7.0 wt % of cesium, 14.0 wt % of iron, 4.5 wt % of copper and 2.5 wt % of zirconium, with the balance being cobalt. The starting material was placed in an alumina crucible and melted in an induction melting furnace under an argon atmosphere, then cast in a mold.

The resulting $Sm_2Co_{17}$-based magnet alloy was reduced to a size of about 500 μm or less with a jaw crusher and a Braun mill, after which it was milled to an average particle size of about 5 μm with a jet mill using a stream of nitrogen. The milled powder was molded with a magnetic field-generating press under a pressure of 1.5 t/cm$^2$ within a magnetic field of 15 kOe. The resulting powder compacts were sintered in a heat treatment furnace under an argon atmosphere at 1170° C. for 2 hours, then solution-treated in argon at 1155° C. for 1 hour. Following the completion of solution treatment, the sintered compacts were quenched, then each was held in an argon atmosphere at 800° C. for 10 hours and gradually cooled to 400° C. at a rate of −1.0° C./min, thereby giving sintered magnets. Magnets measuring 5×5×5 mm were cut from the sintered magnets.

A 15 μm layer of nickel was electroplated onto the resulting magnets using a plating bath adjusted to concentrations of 40 g/L nickel chloride, 270 g/L nickel sulfate and 30 g/L boric acid, and at a bath temperature of 50° C. and a current density of 2.0 A/dm$^2$. The plated magnets were subsequently heat treated at 600° C. for 24 hours in air (oxygen partial pressure, 20 kPa), slowly cooled to room temperature, then coated by spraying on an epoxy resin, yielding hydrogen gas test specimens. The microstructure of the resulting hydrogen gas test specimens was examined with a scanning electron microscope, and the magnetic properties were measured with a VSM.

The hydrogen gas test specimens were each placed in a pressure vessel and subjected to a hydrogen gas test under the following conditions: hydrogen, 10 MPa, 25° C., three days. Following the test, the magnets were removed, their appearance was visually checked, and their magnetic properties were measured with a VSM.

FIG. 1 is a reflection electron microscopy image obtained with a scanning electron microscope of the area near the surface of the magnet produced in Example 3 by covering a rare-earth sintered magnet with a 15 μm layer of plated nickel, then heat-treating at 600° C. for 24 hours in air. A nickel oxide layer having a thickness of about 10 μm can be seen on the surface.

Example 4

Sintered magnets were produced in the same composition and by the same method as in Example 3. As in Example 3, magnets measuring 5×5×5 mm were cut from the resulting sintered magnets. A 15 μm layer of nickel was electroplated onto the resulting magnets under the same conditions as in Example 3. The plated magnets were heat treated at 500° C. for 2 hours in air (oxygen partial pressure, 20 kPa), then slowly cooled to room temperature and subsequently coated by spraying on an epoxy resin, yielding hydrogen gas test specimens. The microstructure of the resulting test specimens was examined with a scanning electron microscope, and the magnetic properties were measured with a VSM.

As in Example 3, the hydrogen gas test specimens were subjected to the same hydrogen gas test. Following the test, the magnets were removed, their appearance was visually checked, and their magnetic properties were measured with a VSM.

Figure 2:
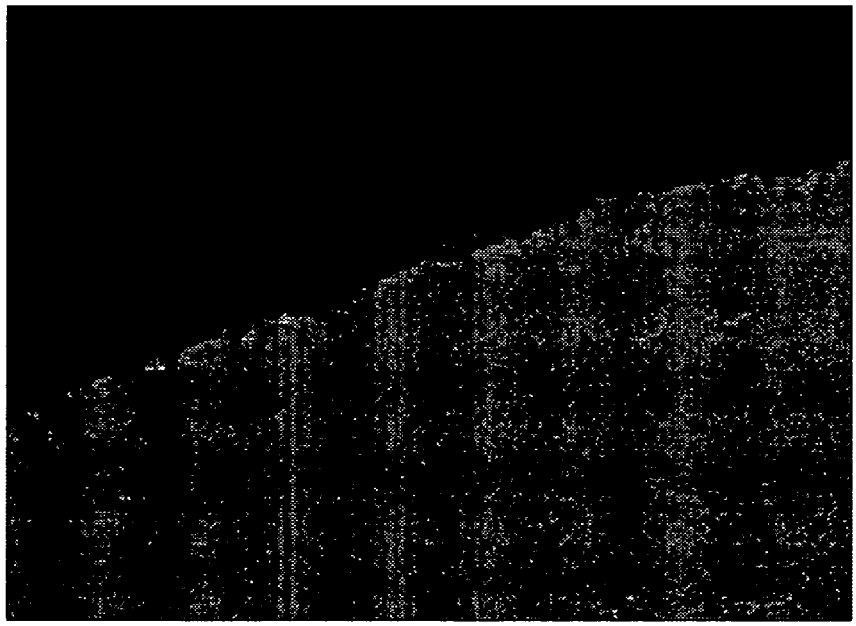
FIG. 2 is a reflection electron microscopy image obtained with a scanning electron microscope of the area near the surface of the magnet produced in Example 4 by covering a rare-earth sintered magnet with a 15 μm layer of plated nickel, then heat-treating at 500° C. for 2 hours in air.

FIG. 2 is a reflection electron microscopy image obtained with a scanning electron microscope of the area near the surface of the rare-earth sintered magnet produced in Example 4 by covering the magnet with a 15 μm layer of plated nickel, then heat-treating at 500° C. for 2 hours in air. A nickel oxide layer having a thickness of about 1 μm can be seen on the surface.

Comparative Example 5

Sintered magnets were produced in the same composition and by the same method as in Example 3. As in Example 3, magnets measuring 5×5×5 mm were cut from the resulting sintered magnets, and coated by spraying on an epoxy resin to give hydrogen gas test specimens. The magnetic properties of the test specimens were measured with a VSM. As in Example 3, the hydrogen gas test specimens were subjected to the same hydrogen gas test. Following the test, the magnets were removed and their appearance was visually checked.

Comparative Example 6

Sintered magnets were produced in the same composition and by the same method as in Example 3. As in Example 3, magnets measuring 5×5×5 mm were cut from the resulting sintered magnets. A 15 μm layer of nickel was electroplated onto the resulting magnets under the same conditions as in Example 3, in addition to which the magnets were coated by spraying on an epoxy resin to give hydrogen gas test specimens. The microstructure of the resulting test specimens was examined with a scanning electron microscope, and their magnetic properties were measured with a VSM. As in Example 3, the hydrogen gas test specimens were subjected to the same hydrogen gas test. Following the test, the magnets were removed and their appearance was visually checked.

Figure 3:
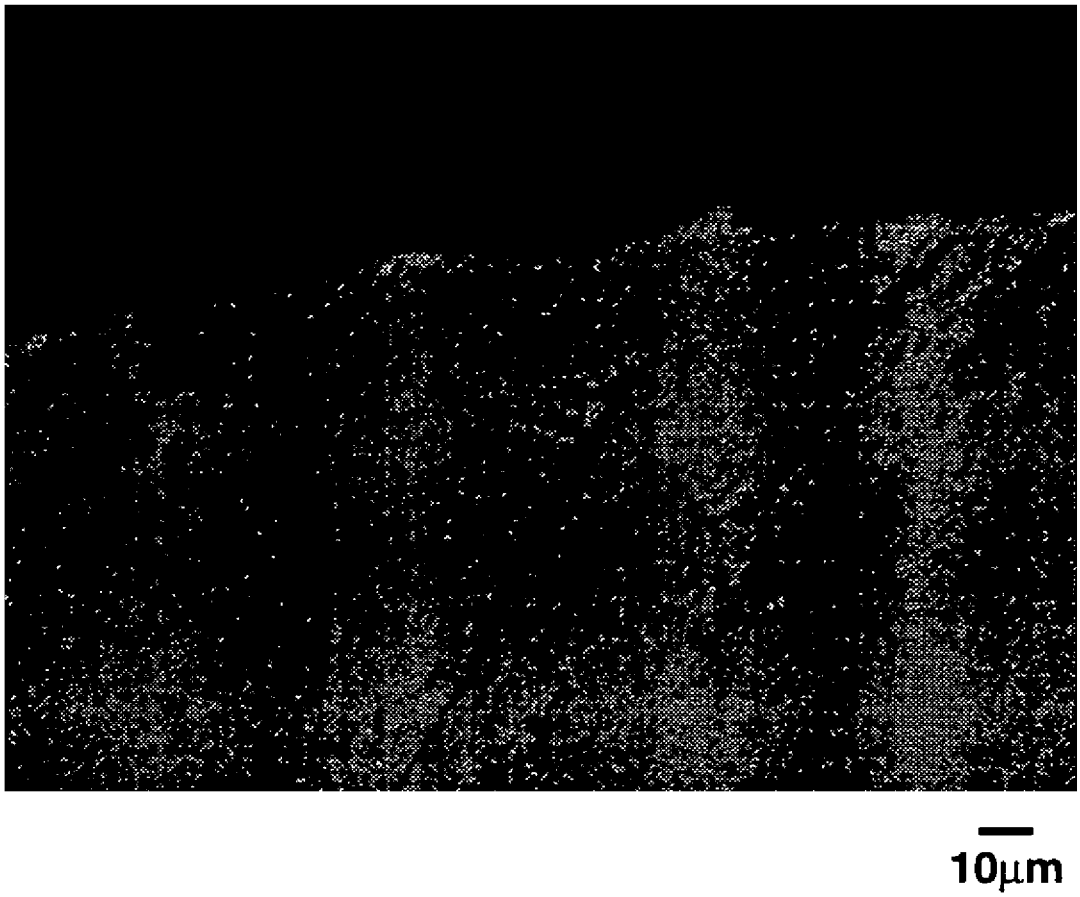
FIG. 3 is a reflection electron microscopy image obtained with a scanning electron microscope of the area near the surface of the magnet produced in Comparative Example 6 by covering a rare-earth sintered magnet with a 15 μm layer of plated nickel.

FIG. 3 is a reflection electron microscopy image obtained with a scanning electron microscope of the area near the surface of the rare-earth sintered magnet produced in Comparative Example 6 by covering the magnet with a 15 μm layer of plated nickel. Unlike in FIGS. 1 and 2, a nickel oxide layer cannot be seen on the surface.

TABLE 3

| | Surface treatment conditions | Hydrogen gas test conditions | Appearance after hydrogen gas test |
|---|---|---|---|
| Example 3 | Ni plating (20 μm) + 600° C., 24-hour heat treatment ($O_2$: 20 kPa) | 10 MPa 25° C. 3 days | no change |
| Example 4 | Ni plating (20 μm) + 500° C., 2-hour heat treatment ($O_2$: 20 kPa) | | no change |
| Comparative Example 5 | not surface treated | | disintegrated |
| Comparative Example 6 | Ni plating | | disintegrated |

Table 3 shows the heat treatment conditions, the hydrogen gas test conditions, and the appearance of the magnets following the hydrogen gas test. In Examples 3 and 4, no change occurred in the hydrogen gas test. However, in Comparative Examples 5 and 6, the magnet disintegrated into small pieces. It is apparent from this that hydrogen embrittlement did not arise in Examples 3 and 4.

TABLE 4

| | Before surface treatment | | | Before hydrogen gas test | | | After hydrogen gas test (10 MPa, 25° C., 3 days) | | |
|---|---|---|---|---|---|---|---|---|---|
| | Br (kG) | iHc (kOe) | $(BH)_{max}$ (MGOe) | Br (kG) | iHc (kOe) | $(BH)_{max}$ (MGOe) | Br (kG) | iHc (kOe) | $(BH)_{max}$ (MGOe) |
| Example 3 | 10.47 | 15.35 | 25.2 | 10.44 | 15.55 | 25.0 | 10.44 | 15.48 | 25.0 |
| Example 4 | 10.48 | 15.12 | 25.3 | 10.45 | 15.62 | 25.1 | 10.45 | 15.57 | 25.1 |
| Comparative Example 5 | 10.41 | 14.98 | 25.1 | 10.41 | 14.98 | 25.1 | | | |
| Comparative Example 6 | 10.51 | 15.50 | 25.3 | 10.48 | 15.35 | 25.2 | | | |

Table 4 shows the magnetic properties of the magnets before surface treatment and before and after the hydrogen gas test. In Examples 3 and 4 according to the invention, the magnetic properties of the magnets remained substantially unchanged before surface treatment and before and after the hydrogen gas test. These results indicate the absence in Examples 3 and 4 of deterioration in magnetic properties due to surface treatment, and the absence of hydrogen embrittlement. In Comparative Example 5 and 6, the magnets disintegrated as a result of hydrogen treatment, making it impossible to measure the magnetic properties following hydrogen treatment.

The results in Tables 3 and 4 show that, in Comparative Examples 5 and 6, surface treatment failed to improve their hydrogen resistance. By contrast, in Examples 3 and 4, surface treatment did not lead to a deterioration in magnetic properties and improved the hydrogen resistance.

Example 5

A $R_2Fe_{14}B$-based magnet alloy was produced by formulating a starting material containing 28.0 wt % of neodymium, 4.0 wt % of dysprosium, 3.5 wt % of cobalt, 1.0 wt % of boron, 0.2 wt % of copper and 0.4 wt % of aluminum, with the balance being iron. The starting material was placed in an alumina crucible and melted in an induction melting furnace under an argon atmosphere, then cast in a mold.

The resulting $R_2Fe_{14}B$-based magnet alloy was reduced to a size of about 500 μm or less with a jaw crusher and a Braun mill, after which it was milled to an average particle size of about 3 μm with a jet mill using a stream of nitrogen. The milled powder was molded with a magnetic field-generating press under a pressure of 1.2 t/cm$^2$ within a magnetic field of 10 kOe. The resulting powder compacts were sintered in a heat treatment furnace under an argon atmosphere at 1070° C. for 2 hours, after which they were cooled and subsequently heat-treated in argon at 600° C. for 1 hour, thereby giving sintered magnets. Magnets measuring 5×5×5 mm were cut from the sintered magnets.

Next, a 5 μm layer of copper, a 5 μm layer of nickel, and a 10 μm layer of nickel were electroplated in this order onto the resulting magnets. Copper electroplating was carried out using a plating bath adjusted to concentrations of 60 g/L copper pyrophosphate, 240 g/L potassium pyrophosphate and 30 g/L potassium oxalate, and at a bath temperature of 40° C. and a current density of 1.5 A/dm$^2$. Next, nickel electroplating was carried out using a plating bath adjusted to concentrations of 40 g/L nickel chloride, 270 g/L nickel sulfate and 30 g/L boric acid, and at a bath temperature of 50° C. and a current density of 2.0 A/dm$^2$. This was followed by another nickel electroplating step under the same conditions as the first nickel plating step. The plated magnets were subsequently heat treated at 300° C. for 50 hours in air (oxygen partial pressure, 20 kPa), slowly cooled to room temperature, then coated by spraying on an epoxy resin, yielding hydrogen gas test specimens. The magnetic properties of the resulting hydrogen gas test specimens were measured with a VSM.

The hydrogen gas test specimens were each placed in a pressure vessel and subjected to a hydrogen gas test under the following conditions: hydrogen, 10 MPa, 25° C., one day. Following the test, the magnets were removed, their appearance was visually checked, and their magnetic properties were measured with a VSM.

Example 6

Sintered magnets were produced in the same composition and by the same method as in Example 5. As in Example 5, magnets measuring 5×5×5 mm were cut from the resulting sintered magnets. A 5 μm layer of copper, a 5 μm layer of nickel and a 10 μm layer of nickel were electroplated onto the resulting magnets in this order under the same conditions as in Example 5. The plated magnets were heat treated at 250° C. for 3 hours in a vacuum (oxygen partial pressure, $1\times10^{-2}$ Pa), slowly cooled to room temperature, then coated by spraying on an epoxy resin, yielding hydrogen gas test specimens. The magnetic properties of the resulting hydrogen gas test specimens were measured with a VSM. The test specimens were subjected to a hydrogen gas test under the same conditions as in Example 5. Following the test, the magnets were removed, their appearance was visually checked, and their magnetic properties were measured with a VSM.

Comparative Example 7

Sintered magnets were produced in the same composition and by the same method as in Example 5. As in Example 5, magnets measuring 5×5×5 mm were cut from the resulting sintered magnets, and coated by spraying on an epoxy resin to give hydrogen gas test specimens. The magnetic properties of the test specimens were measured with a VSM. The hydrogen gas test specimens were subjected to a hydrogen gas test under the same conditions as in Example 5. Following the test, the magnets were removed and their appearance was visually checked.

Comparative Example 8

Sintered magnets were produced in the same composition and by the same method as in Example 5. As in Example 5, magnets measuring 5×5×5 mm were cut from the resulting sintered magnets. A 5 μm layer of copper, a 5 μm layer of nickel and a 10 μm layer of nickel were electroplated onto the resulting magnets in this order under the same conditions as in Example 5. The plated magnets were then coated by spraying on an epoxy resin, yielding hydrogen gas test specimens. The magnetic properties of the resulting hydrogen gas test specimens were measured with a VSM. The test specimens were subjected to a hydrogen gas test under the same conditions as in Example 5. Following the test, the magnets were removed and their appearance was visually checked.

Comparative Examples 9 and 10

Sintered magnets were produced in the same composition and by the same method as in Example 5. As in Example 5, magnets measuring 5×5×5 mm were cut from the resulting sintered magnets. A 5 μm layer of copper, a 5 μm layer of nickel and a 10 μm layer of nickel were electroplated onto the resulting magnets in this order under the same conditions as in Example 5. In Comparative Example 9, heat treatment was subsequently carried out at 50° C. for 12 hours in air (oxygen partial pressure, 20 kPa). In Comparative Example 10, heat treatment was subsequently carried out at 800° C. for 12 hours in air (oxygen partial pressure, 20 kPa). In both examples, the heat-treated magnets were slowly cooled to room temperature, then coated by spraying on an epoxy resin to give hydrogen gas test specimens. The magnetic properties of the test specimens were measured with a VSM. The hydrogen gas test specimens were subjected to a hydrogen gas test under the same conditions as in Example 5, then removed from the pressure vessel. Following removal, the appearance of each magnet was visually checked and its magnetic properties were measured with a VSM.

TABLE 5

| | Surface treatment conditions | Hydrogen gas test conditions | Appearance after hydrogen gas test | Thickness of surface layer |
|---|---|---|---|---|
| Example 5 | Cu—Ni—Ni plating + 300° C., 50-hour heat treatment ($O_2$: 20 kPa) | 10 MPa 25° C. 1 day | no change | 2 μm |
| Example 6 | Cu—Ni—Ni plating + 250° C., 3-hour heat treatment ($O_2$: $1 \times 10^{-2}$ Pa) | | no change | 0.5 μm |
| Comparative Example 7 | not surface treated | | disintegrated | — |
| Comparative Example 8 | Cu—Ni—Ni plating | | disintegrated | — |
| Comparative Example 9 | Cu—Ni—Ni plating + 50° C., 12-hour heat treatment ($O_2$: 20 kPa) | | disintegrated | not measurable* |
| Comparative Example 10 | Cu—Ni—Ni plating + 800° C., 12-hour heat treatment ($O_2$: 20 kPa) | | no change | 18 μm |

*An oxide layer did form, but it was too thin to be measured.

Table 5 shows the heat treatment conditions, the hydrogen gas test conditions, and the appearance of the magnets following the hydrogen gas test. In Examples 5 and 6 and Comparative Example 10, no change occurred in the hydrogen gas test. However, in Comparative Examples 7, 8 and 9, the magnet disintegrated into small pieces. It is apparent from this that hydrogen embrittlement did not arise in Examples 5 and 6 and Comparative Example 10.

Thus, Tables 5 and 6 show that, in Comparative Examples 7 to 10, surface treatment either led to a clear deterioration in the magnetic properties of the magnets or failed to improve their hydrogen resistance. By contrast, in Examples 5 and 6, surface treatment did not lead to a deterioration in magnetic properties and improved the hydrogen resistance.

TABLE 6

| | Before surface treatment | | | Before hydrogen gas test | | | After hydrogen gas test | | |
|---|---|---|---|---|---|---|---|---|---|
| | Br (kG) | iHc (kOe) | $(BH)_{max}$ (MGOe) | Br (kG) | iHc (kOe) | $(BH)_{max}$ (MGOe) | Br (kG) | iHc (kOe) | $(BH)_{max}$ (MGOe) |
| Example 5 | 11.85 | 17.05 | 34.0 | 11.74 | 16.88 | 32.7 | 11.75 | 16.85 | 32.7 |
| Example 6 | 11.83 | 17.21 | 33.9 | 11.72 | 16.99 | 32.6 | 11.71 | 17.02 | 32.6 |
| Comparative Example 7 | 11.92 | 16.77 | 34.4 | 11.80 | 16.52 | 33.0 | | | |
| Comparative Example 8 | 11.88 | 16.85 | 34.2 | 11.77 | 16.63 | 32.9 | | | |
| Comparative Example 9 | 11.85 | 17.01 | 34.0 | 11.72 | 16.95 | 32.6 | | | |
| Comparative Example 10 | 11.84 | 17.12 | 34.0 | 11.75 | 10.15 | 17.2 | 11.72 | 10.23 | 17.2 |

Table 6 shows the magnetic properties of the magnets before surface treatment and before and after the hydrogen gas test. In Examples 5 and 6 according to the invention, the magnetic properties of the magnets remained substantially unchanged before surface treatment and before and after the hydrogen gas test. By contrast, in Comparative Example 10, the magnetic properties of the magnet before surface treatment were very different from those before the hydrogen gas test. These results indicate the absence in Examples 5 and 6 of deterioration in magnetic properties due to surface treatment and the absence of hydrogen embrittlement. The results also indicate that surface treatment in Comparative Example 10 led to a deterioration in the magnetic properties. In Comparative Examples 7, 8 and 9, the magnets disintegrated as a result of hydrogen treatment, making it impossible to measure the magnetic properties following hydrogen treatment.

Example 7

A $R_2Fe_{14}B$-based magnet alloy was produced by formulating a starting material containing 29.0 wt % of neodymium, 3.0 wt % of dysprosium, 3.5 wt % of cobalt, 1.0 wt % of boron, 0.1 wt % of copper and 0.1 wt % of aluminum, with the balance being iron. The starting material was placed in an alumina crucible and melted in an induction melting furnace under an argon atmosphere, then cast in a mold.

The resulting $R_2Fe_{14}B$-based magnet alloy was reduced to a size of about 500 μm or less with a jaw crusher and a Braun mill, after which it was milled to an average particle size of about 3 μm with a jet mill using a stream of nitrogen. The milled powder was molded with a magnetic field-generating press under a pressure of 1.2 t/cm$^2$ within a magnetic field of 10 kOe. The resulting powder compacts were sintered in a heat treatment furnace under an argon atmosphere at 1070° C. for 2 hours, after which they were cooled and subsequently heat-treated in argon at 600° C. for 1 hour, thereby giving sintered magnets. Magnets measuring 5×5×5 mm were cut from the sintered magnets.

Next, a 10 μm layer of copper and a 10 μm layer of nickel were electroplated in this order onto the resulting magnets. Copper electroplating was carried out using a plating bath adjusted to concentrations of 60 g/L copper pyrophosphate, 240 g/L potassium pyrophosphate and 30 g/L potassium oxalate, and at a bath temperature of 40° C. and a current density of 1.5 A/dm$^2$. Next, nickel electroplating was carried out using a plating bath adjusted to concentrations of 40 g/L nickel chloride, 270 g/L nickel sulfate and 30 g/L boric acid, and at a bath temperature of 50° C. and a current density of 2.0 A/dm$^2$. The plated magnets were subsequently heat treated at 350° C. for 50 hours in air, then slowly cooled to room temperature, yielding hydrogen gas test specimens. The microstructure of the resulting hydrogen gas test specimens was examined with a scanning electron microscope. The metal plating metal was found to have formed an oxide, and the thickness of this oxide top layer was measured. The magnetic properties of the test specimens were measured with a VSM.

The hydrogen gas test specimens were each placed in a pressure vessel and subjected to a hydrogen gas test under the following conditions: hydrogen, 5 MPa, 25° C., three days. Following the test, the magnets were removed, their appearance was visually checked, and their magnetic properties were measured with a VSM.

Example 8

Sintered magnets were produced in the same composition and by the same method as in Example 7. As in Example 7, magnets measuring 5×5×5 mm were cut from the resulting sintered magnets. A 10 μm layer of copper and a 10 μm layer of nickel were electroplated in this order onto the resulting magnets under the same conditions as in Example 7. The plated magnets were heat treated at 300° C. for 2 hours in air, then slowly cooled to room temperature, yielding hydrogen gas test specimens. The microstructure of the resulting test specimens was examined with a scanning electron microscope, and the thickness of the metal plating metal oxide layer was measured. The magnetic properties of the test specimens were measured with a VSM.

As in Example 7, the hydrogen gas test specimens were each placed in a pressure vessel and subjected to the same hydrogen gas test. Following the test, the magnets were removed, their appearance was visually checked, and their magnetic properties were measured with a VSM.

Comparative Example 11

Sintered magnets were produced in the same composition and by the same method as in Example 7. As in Example 7, magnets measuring 5×5×5 mm were cut from the resulting sintered magnets, giving hydrogen gas test specimens. The magnetic properties of the test specimens were measured with a VSM. As in Example 7, the hydrogen gas test specimens were subjected to the same hydrogen gas test. Following the test, the magnets were removed and their appearance was visually checked.

Comparative Example 12

Sintered magnets were produced in the same composition and by the same method as in Example 7. As in Example 7, magnets measuring 5×5×5 mm were cut from the resulting sintered magnets. A 10 μm layer of copper and a 10 μm layer of nickel were electroplated in this order onto the resulting magnets under the same conditions as in Example 7, giving hydrogen gas test specimens. The microstructure of the resulting test specimens was examined with a scanning electron microscope, and their magnetic properties were measured with a VSM. As in Example 7, the hydrogen gas test specimens were subjected to the same hydrogen gas test. Following the test, the magnets were removed and their appearance was visually checked.

TABLE 7

| | Surface treatment conditions | Hydrogen gas test conditions | Appearance after hydrogen gas test | Thickness of surface layer |
|---|---|---|---|---|
| Example 7 | Cu—Ni plating + 350° C., 50-hour heat treatment in air | 5 MPa 25° C. 3 days | no change | 4 μm |
| Example 8 | Cu—Ni plating + 300° C., 2-hour heat treatment in air | | no change | 0.5 μm |
| Comparative Example 11 | not surface treated | | disintegrated | — |
| Comparative Example 12 | Cu—Ni plating | | disintegrated | — |

TABLE 8

| | Before surface treatment | | | Before hydrogen gas test | | | After hydrogen gas test (5 MPa, 25° C., 3 days) | | |
|---|---|---|---|---|---|---|---|---|---|
| | Br (kG) | iHc (kOe) | $(BH)_{max}$ (MGOe) | Br (kG) | iHc (kOe) | $(BH)_{max}$ (MGOe) | Br (kG) | iHc (kOe) | $(BH)_{max}$ (MGOe) |
| Example 7 | 13.05 | 14.98 | 41.2 | 13.01 | 14.35 | 40.6 | 13.02 | 14.38 | 40.6 |
| Example 8 | 13.11 | 14.65 | 41.6 | 13.03 | 14.55 | 40.7 | 13.01 | 14.52 | 40.7 |
| Comparative Example 11 | 13.08 | 14.77 | 41.4 | 13.06 | 14.75 | 41.2 | | | |
| Comparative Example 12 | 13.05 | 14.50 | 41.2 | 13.00 | 14.33 | 40.7 | | | |

Table 8 shows the magnetic properties of the magnets before surface treatment and before and after the hydrogen gas test. In Examples 7 and 8 according to the invention, the magnetic properties of the magnets remained substantially unchanged before surface treatment and before and after the hydrogen gas test. These results indicate the absence in Examples 5 and 6 of deterioration in magnetic properties due to surface treatment and the absence of hydrogen embrittlement. In Comparative Examples 11 and 12, the magnets disintegrated as a result of hydrogen treatment, making it impossible to measure the magnetic properties following hydrogen treatment.

As is apparent from the results in Tables 7 and 8, the hydrogen gas test gave rise to hydrogen embrittlement in the comparative examples, but did not give rise to hydrogen embrittlement in the examples according to the invention. This shows that surface treatment did not lead to a deterioration in the magnetic properties and enhanced the hydrogen resistance.

As demonstrated above, the $Sm_2Co_{17}$-based sintered magnets and $R_2Fe_{14}B$-based sintered magnets of the invention are rare-earth sintered magnets which can be used in motors and other devices within a hydrogen atmosphere without undergoing hydrogen embrittlement.

The invention claimed is:

1. A method of manufacturing rare-earth sintered magnets, characterized by subjecting an alloy composed of 20 to 30 wt % of a constituent R (R being samarium alone or at least 50 wt % samarium in combination with one or more other rare-earth element), 10 to 45 wt % iron, 1 to 10 wt % copper and 0.5 to 5 wt % zirconium, with the balance being cobalt and inadvertent impurities, to the steps of, in order, melting, casting, coarse size reduction, milling, molding in a magnetic field, sintering and aging so as to form a sintered magnet, surface machining the sintered magnet by cutting and/or grinding, metal plating the surface-machined magnet with a metal-plating metal, then heat treating the metal-plated magnet at 80 to 850° C. for a period of from 10 minutes to 50 hours in an argon, nitrogen, air or low-pressure vacuum atmosphere having an oxygen partial pressure of $10^{-4}$Pa to 50 kPa to form an oxide layer of the metal-plating metal as a hydrogen resistance layer, the metal-plating metal being one or more selected from among copper, nickel, cobalt, tin, and alloys thereof.

2. A rare-earth sintered magnet comprising:

20 to 30 wt % of a constituent R (R being samarium alone or at least 50 wt % samarium in combination with one or more other rare-earth element);

10 to 45 wt % iron;

1 to 10 wt % copper; and 0.5 to 5 wt % zirconium, with the balance being cobalt and inadvertent impurities, wherein said rare-earth sintered magnet has a metal oxide layer and/or a metal nitride layer on a surface thereof, over an intervening metal-plating layer, the intervening metal-plating layer comprising one or more selected from among copper, nickel, cobalt, tin, and alloys thereof.

3. The rare-earth sintered magnet of claim 2, wherein the metal-plating layer and the metal oxide layer and/or metal nitride layer have a combined thickness of at least 1 μm but not more than 100 μm.

4. A method of manufacturing rare-earth sintered magnets, characterized by subjecting an alloy composed of 20 to 35 wt % of a constituent R (R being one or more rare-earth element selected from among neodymium, praseodymium, dysprosium, terbium and holmium), up to 15 wt % cobalt 0.2 to 8 wt % boron, and up to 8 wt % of one or more element selected from among nickel, niobium, aluminum, titanium, zirconium, chromium, vanadium, manganese, molybdenum, silicon, tin, gallium, copper and zinc as an additive, with the balance being iron and inadvertent impurities, to the steps of, in order, melting, casting, coarse size reduction, milling, molding in a magnetic field, sintering and heat treatment to form a sintered magnet, surface machining the sintered magnet by cutting and/or grinding, metal plating the surface-machined magnet with a metal-plating metal so as to form a multilayer comprising a copper bottom layer followed by one or more nickel layer, then heat treating the metal-plated magnet at 80 to 700° C. for a period of from 10 minutes to 50 hours in an argon, nitrogen, air or low-pressure vacuum atmosphere having an oxygen partial pressure of $10^{-4}$Pa to 50 kPa to form an oxide layer of nickel as a hydrogen resistance layer.

5. A rare-earth sintered magnet comprising:

20 to 35 wt % of a constituent R (R being one or more rare-earth element selected from among neodymium, praseodymium, dysprosium, terbium and holmium);

up to 15 wt % cobalt;

0.2 to 8 wt % boron; and up to 8 wt % of one or more element selected from among nickel, niobium, aluminum, titanium, zirconium, chromium, vanadium, manganese, molybdenum, silicon, tin, gallium, copper and zinc as an additive, with the balance being iron and inadvertent impurities, wherein said rare-earth sintered magnet has a metal oxide layer and/or a metal nitride layer on a surface thereof, over n metal-plating layers (n being an integer such that $n \geqq 1$), the metal-plating layer being a multilayer comprising a copper bottom layer followed by one or more nickel layer.

6. The rare-earth sintered magnet of claim 5, wherein the metal-plating layer and the metal oxide layer and/or metal nitride layer have a combined thickness of at least 1 μm but not more than 100 μm.

7. The method of manufacturing rare-earth sintered magnets of claim 1, wherein the surface-machined magnet is metal plated with a metal-plating metal so as to form a copper layer or a nickel layer, or a multilayer comprising a copper bottom layer followed by one or more nickel layer.

8. The rare-earth sintered magnet of claim 2, wherein the intervening metal-plating layer is copper layer or nickel layer, or a multilayer comprising a copper bottom layer followed by one or more nickel layer.

9. The method of manufacturing rare-earth sintered magnet of claim 1, wherein the metal plating is electroplating.

10. The rare-earth sintered magnet of claim 2, wherein the metal plating is electroplating.

11. The method of manufacturing rare-earth sintered magnet of claim 4, wherein the metal plating is electroplating.

12. The rare-earth sintered magnet of claim 5, wherein the metal plating is electroplating.

13. The method of manufacturing rare-earth sintered magnets of claim 1, wherein the plating thickness is 1 to 100 μm and the thickness of the oxide layer is 0.1 to 100 μm.

14. The rare-earth sintered magnet of claim 3, wherein the thickness of the metal oxide layer and/or metal nitride layer is at least 0.1 μμm but not more than 20 μm.

15. The method of manufacturing rare-earth sintered magnets of claim 4, wherein the plating thickness is 1 to 100 μm and the thickness of the oxide layer is 0.1 to 100 μm.

16. The rare-earth sintered magnet of claim 6, wherein the thickness of the metal oxide layer and/or metal nitride layer is at least 0.1 μm but not more than 20 μm.

* * * * *